US006564405B1

(12) United States Patent
Barr et al.

(10) Patent No.: US 6,564,405 B1
(45) Date of Patent: May 20, 2003

(54) MATERNITY PATIENT SUPPORT

(75) Inventors: Jason Lawrence Barr, Lawton, MI (US); David Edwin Seelbinder, Kalamazoo, MI (US); Mark S. Feddema, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/211,905

(22) Filed: Aug. 2, 2002

(51) Int. Cl.[7] ..... A61G 7/075
(52) U.S. Cl. ..... 5/602; 5/662
(58) Field of Search ..... 5/602, 662, 428, 5/429, 430

(56) References Cited

U.S. PATENT DOCUMENTS 3,930,273 A * 1/1976 Stern ..... 5/430
4,747,171 A * 5/1988 Einsele et al. ..... 5/425
5,060,327 A 10/1991 Celestina et al.
5,388,294 A * 2/1995 Reeder ..... 5/600
5,806,111 A * 9/1998 Heimbrock et al. ..... 5/86.1
6,240,583 B1 * 6/2001 Brooke et al. ..... 5/662
6,427,269 B1 8/2002 Feddema

* cited by examiner

*Primary Examiner*—Michael F. Trettel
(74) *Attorney, Agent, or Firm*—Flynn, Thiel, Boutell & Tanis, P.C.

(57) ABSTRACT

A labor grip mechanism on each side of a main frame of a birthing bed, each labor grip mechanism having a post with a free end and a hand grip mounted on the free end. A first mounting construction is provided for slidably supporting each post for simultaneous movement between a first position wherein the hand grip is stowed underneath the patient support and a second position wherein the hand grip is oriented wholly out from underneath the patient support. A second mounting construction is provided for supporting each post for simultaneous rotational movement between the second position wherein the hand grip is also oriented in a plane beneath the plane of the patient support and a third position wherein the hand grip is oriented in a plane above the plane of the patient support. A hand grip positioning device is provided for facilitating the rotational movement only when the posts are in the aforesaid second or third position.

8 Claims, 6 Drawing Sheets

MATERNITY PATIENT SUPPORT

FIELD OF THE INVENTION

This invention relates to a birthing bed and, more particularly, to a birthing bed equipped with a labor grip mechanism on each side of the bed to assist the mother in creating maximum thrust during the birthing process.

BACKGROUND OF THE INVENTION

It is widely known to provide labor grip mechanisms on a birthing bed to assist the mother in creating maximum thrust during the birthing process. U.S. Pat. No. 5,060,327 and pending application Ser. No. 09/614,357, filed Jul. 12, 2000, now U.S. Pat. No. 6,427,269 are cited as two exemplary forms of a labor grip mechanism on a birthing bed. It is desirable to simultaneously deploy the labor grip mechanism and to move the labor grip mechanism to a stowed position out of the way when they are not needed.

Accordingly, it is an object of this invention to provide a labor grip mechanism on both sides of a birthing bed and which are simultaneously movable between a stowed position beneath the patient support and an in-use position wherein the hand grip is oriented above the upper surface of the patient support.

It is a further object of this invention to provide a labor grip mechanism, as aforesaid, wherein the action required to effect a simultaneous deployment of both of the labor grip mechanisms is quick and simple.

It is a further object of the invention to provide a labor grip mechanism, as aforesaid, which is durable, steady to the birthing mother thereby psychologically causing the birthing mother to apply strong forces thereto in creating the maximum thrust forces required to assist in the birthing process.

It is a further object of the invention to provide a labor grip mechanism, as aforesaid, wherein the entirety of the labor grip mechanism is stowable wholly beneath the patient support.

SUMMARY OF THE INVENTION

The objects and purposes of the invention are met by providing a labor grip mechanism on each side of a main frame of a birthing bed, each labor grip mechanism having a post with a free end and a hand grip mounted on the free end. A first mounting construction is provided for slidably supporting the posts for simultaneous movement between a first position wherein the hand grips are stowed underneath the patient support and a second position wherein the hand grips are oriented wholly out from underneath the patient support. A second mounting construction is provided for supporting the posts for simultaneous rotational movement between the second position wherein the hand grips are also oriented in a plane beneath the plane of the patient support and a third position wherein the hand grips are oriented in a plane above the plane of the patient support. A hand grip positioning device is provided for facilitating the simultaneous rotational movement only when the posts are in the aforesaid second or third positions.

BRIEF DESCRIPTION OF THE DRAWINGS

Other objects and purposes of this invention will be apparent to persons acquainted with labor grip mechanisms of this general type upon reading the following specification and inspecting the accompanying drawings, in which.

DETAILED DESCRIPTION

Figure 1:
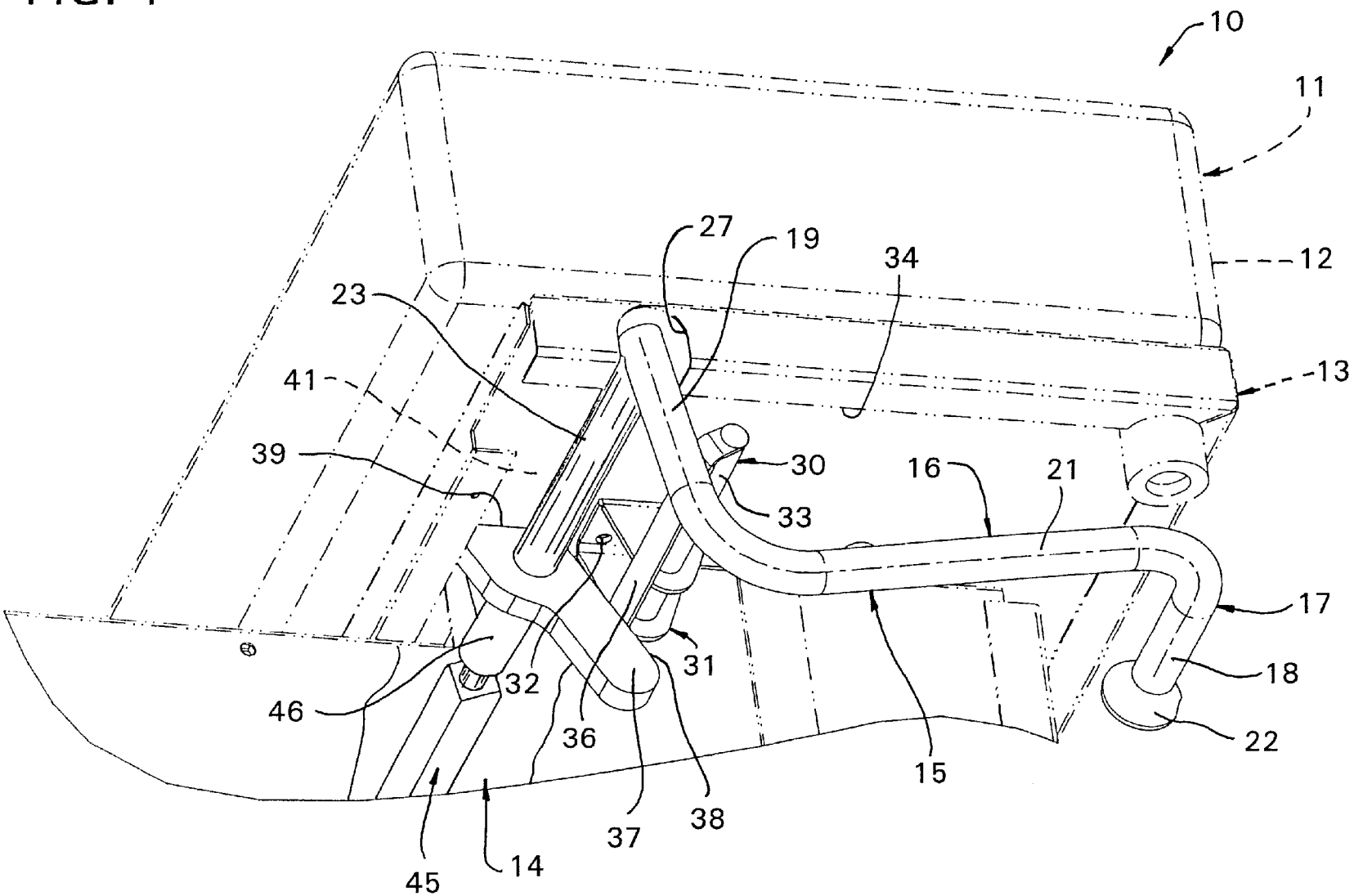
FIG. 1 is a bottom left isometric view of a labor grip mechanism in the first position thereof.
Figure 2:
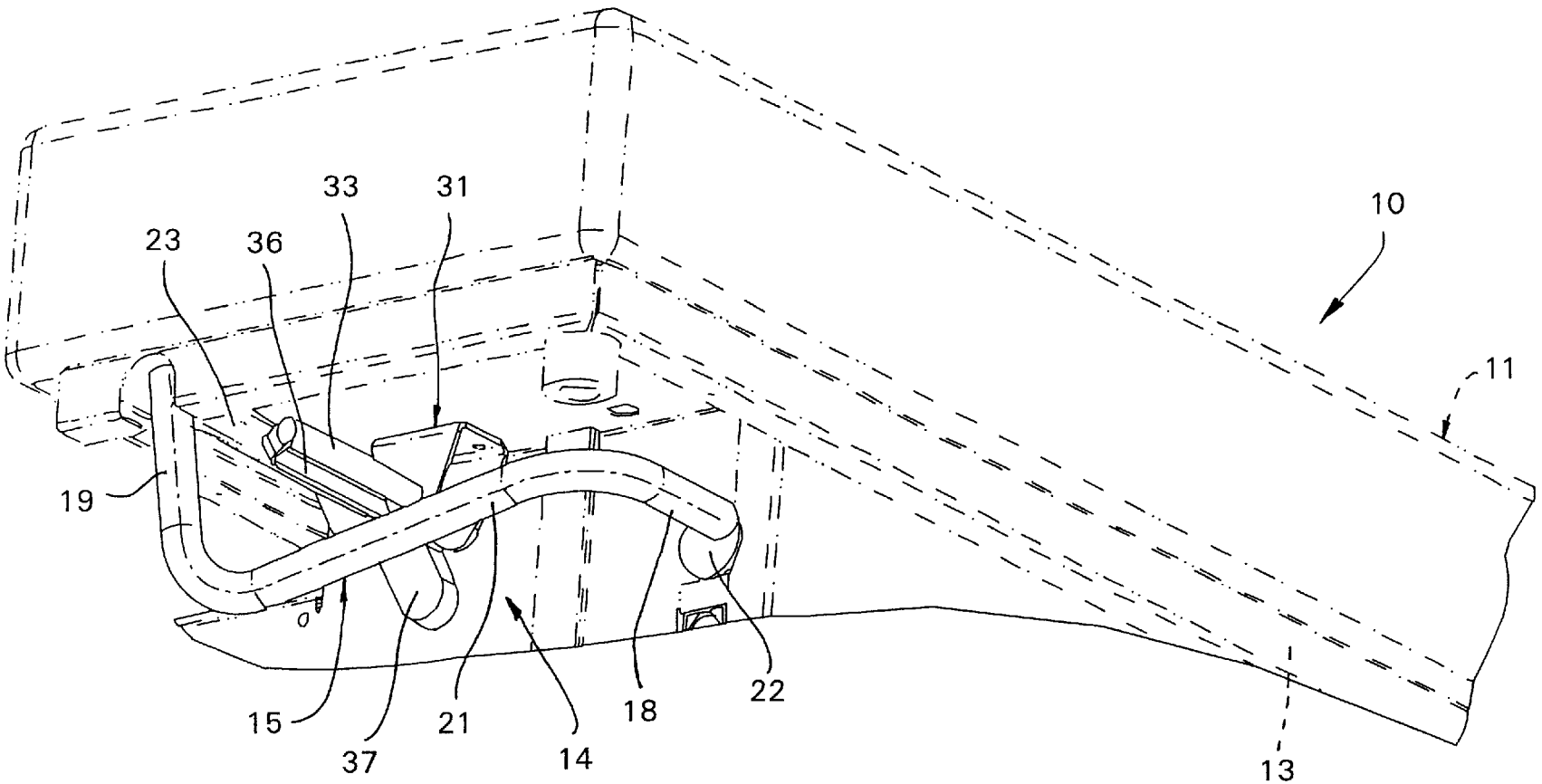
FIG. 2 is a bottom right isometric view of the labor grip mechanism in the same position as has been illustrated in FIG. 1.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

In the drawings, only a fragment of a birthing bed 10 has been illustrated, namely, that part of the bed 10 having a mattress section 11 upon which the birthing mother sits with her legs extending beyond the right edge 12 thereof. If desired, another mattress surface can be provided to the right of the mattress section 11 and therebelow so that the feet of the birthing mother can rest thereon.

The mattress section 11 is supported on a mattress frame 13 which in turn is elevatably supported on a main frame 14. The mechanism for elevating the mattress frame 13 up and down in relation to the main frame 14 is well known in the art and, accordingly, a further detailed discussion thereof is believed unnecessary.

Figure 6:
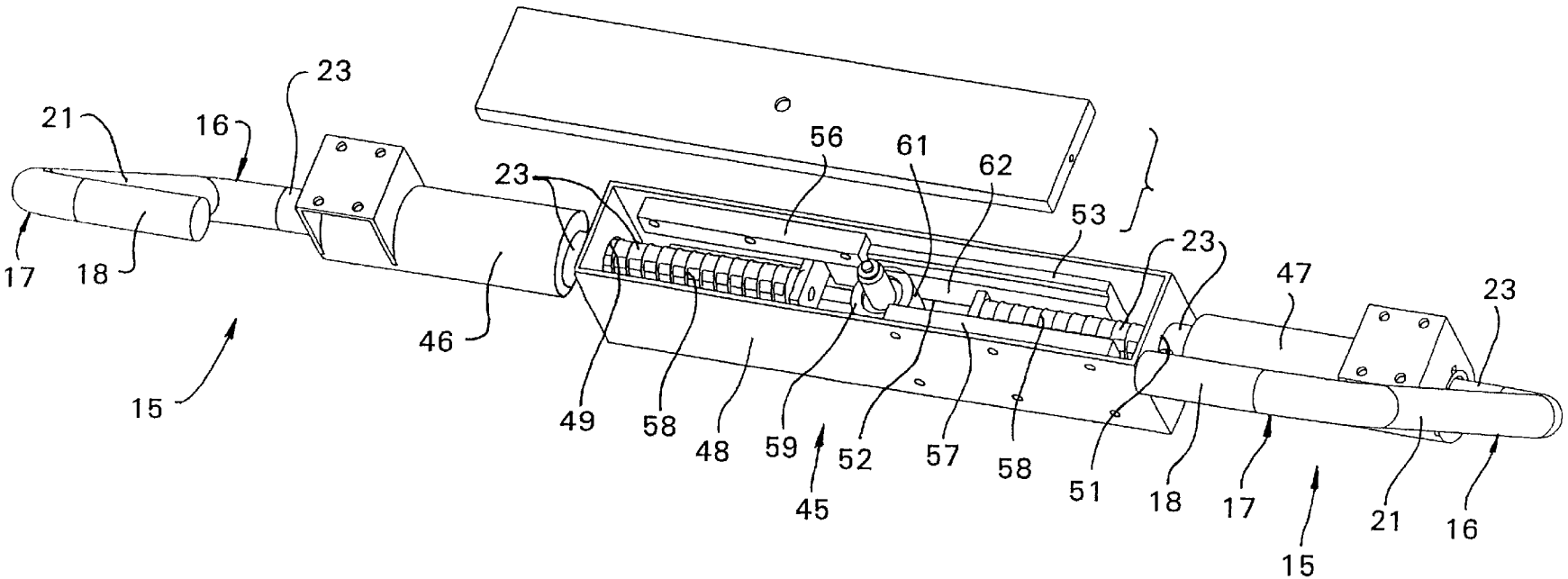
FIG. 6 is an isometric view of a rack and pinion mechanism for providing simultaneous movement of the labor grips.

A labor grip mechanism 15 is mounted on both lateral sides of the main frame 14 as shown in FIG. 6 and both labor grip mechanisms are the mirror image of each other and include a post 16 having a free end section 17 and a hand grip 18 mounted at the aforesaid free end 17. For purposes of simplifying this disclosure, only one labor grip mechanism is shown in the drawings and will be described in detail.

In this particular embodiment, the post 16 is an elongate rod-like member having a first section 19 and a second section 21 forming an angle θ (FIG. 3) formed therebetween. The handle 18 is a continuation of the rod-like member and is bent at a 90° angle with respect to the section 21. A protective member 22 is secured to the free end of the pipe section, namely, the handle 18.

The labor grip mechanism 15 further includes an elongate straight rod section 23 connected at a right angle to the rod section 19. The straight section 23 is supported in a guide opening 24 provided on the main frame 14, which guide opening guides the straight section 23 between a first position thereof illustrated in FIG. 1 and a second position thereof illustrated in FIG. 3. An additional support mechanism 45 described in more detail below in reference to FIG. 6 is provided for assisting the guiding of the straight section 23 between the aforesaid first and second sections, particularly in order to stabilize the straight section 23 when it is in the second position illustrated in FIG. 3. A spring 26 is either anchored to the main frame 14 on a side of the birthing bed remote from the side illustrated in FIG. 3 of the drawings and is connected at the other end to the end of the straight section 23 remote from the rod section 19 or is embodied in the additional support mechanism 45 discussed in more detail below. As the straight section is transitioned between the first and second positions, the spring 26 will generate a return force urging the straight section 23 and, consequently, the labor grip mechanism to the first position of the labor grip mechanism illustrated in FIG. 1. While the spring 26 is illustrated in FIG. 3 as a tension spring, it will be recognized by those of ordinary skill in the art that the straight section 23 can be configured to operate utilizing a compression spring as will be described below with reference to FIG. 6.

Figure 3:
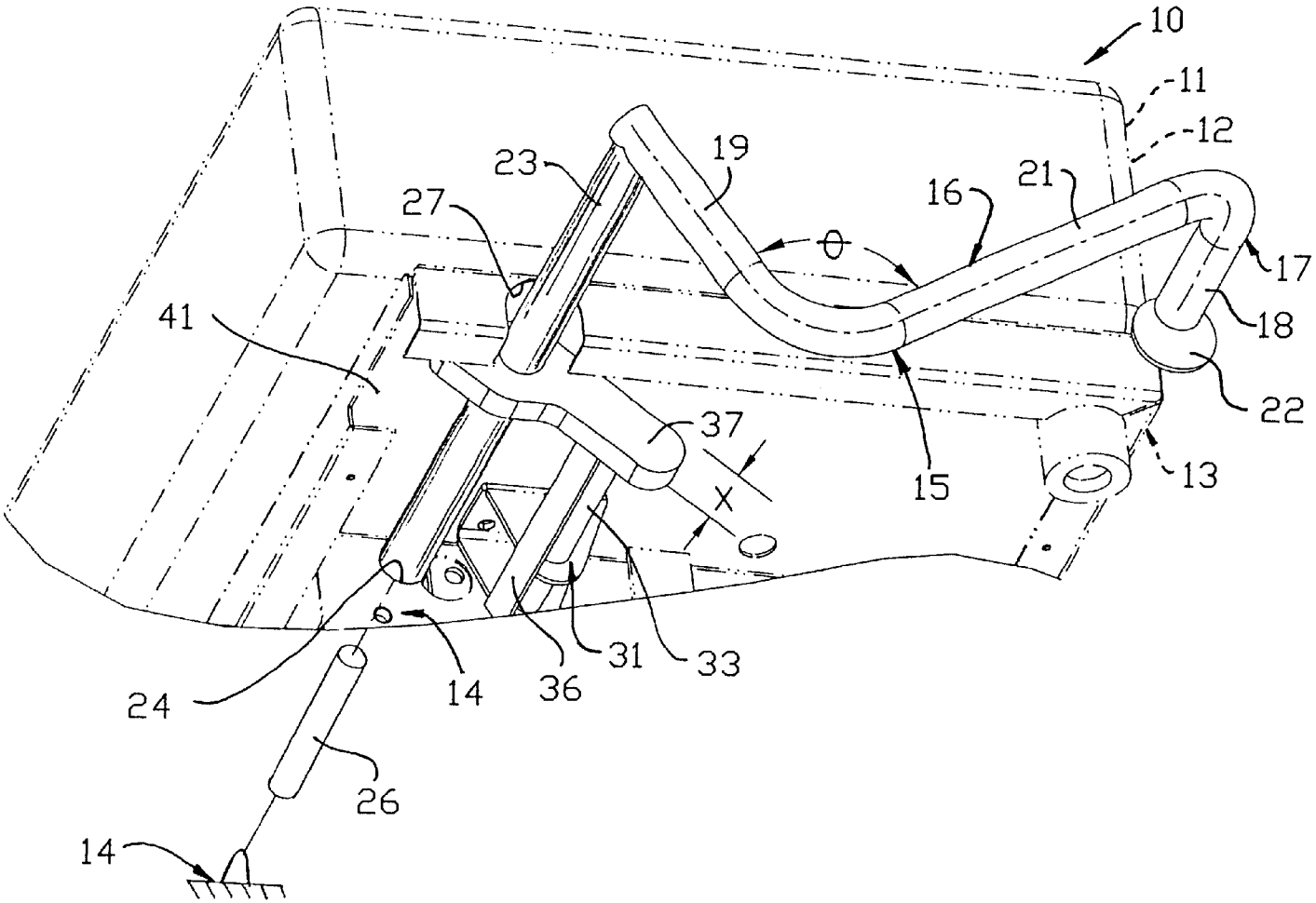
FIG. 3 is a bottom left isometric view similar to FIG. 1, but with the labor grip mechanism moved to a second position.

As is illustrated in the drawings, the mattress frame 13 includes a cut out section 27 of a sufficient dimension to permit the region of the labor grip mechanism 15 adjacent the juncture between the rod section 19 and the straight section 23 to move therethrough when the labor grip mechanism 15 is transitioning between the first position illustrated in FIG. 1 and the second position illustrated in FIG. 3.

A hand grip positioning bracket 30 is secured by means of a base member 31 to the underside of the mattress frame 13 by means of a plurality of screws (not illustrated) received in appropriate holes 32. An elongate rod 33 is secured to the base member 31 and extends in a direction generally parallel to the straight section 23. The distal end of the rod 33 terminates adjacent an outer edge 34 of the mattress frame 13. A reinforcement or bracing member 36 is secured to the base member 31 and the distal end of the rod 33. The brace 36 also provides a smooth surface between the end thereof adjacent the main frame 14 through to the end thereof adjacent the distal end of the rod 33.

An elongate arm, also known as a cam, 37 is secured to the straight section 23 and is movable therewith in all directions of movement of the straight section 23. The cam 37 extends radially outwardly from the straight section 23 and a surface 38 thereof is configured to engage the surface of the brace 36 so as to prevent counterclockwise rotation of the labor grip mechanism 15 about an axis defined by the longitudinal axis of the straight section 23. Rotational movements of the labor grip mechanism 15 in the opposite direction, namely, the clockwise direction is prevented by a surface 39 on the cam 37 engaging the undersurface 41 of the mattress frame 13.

Figure 4:
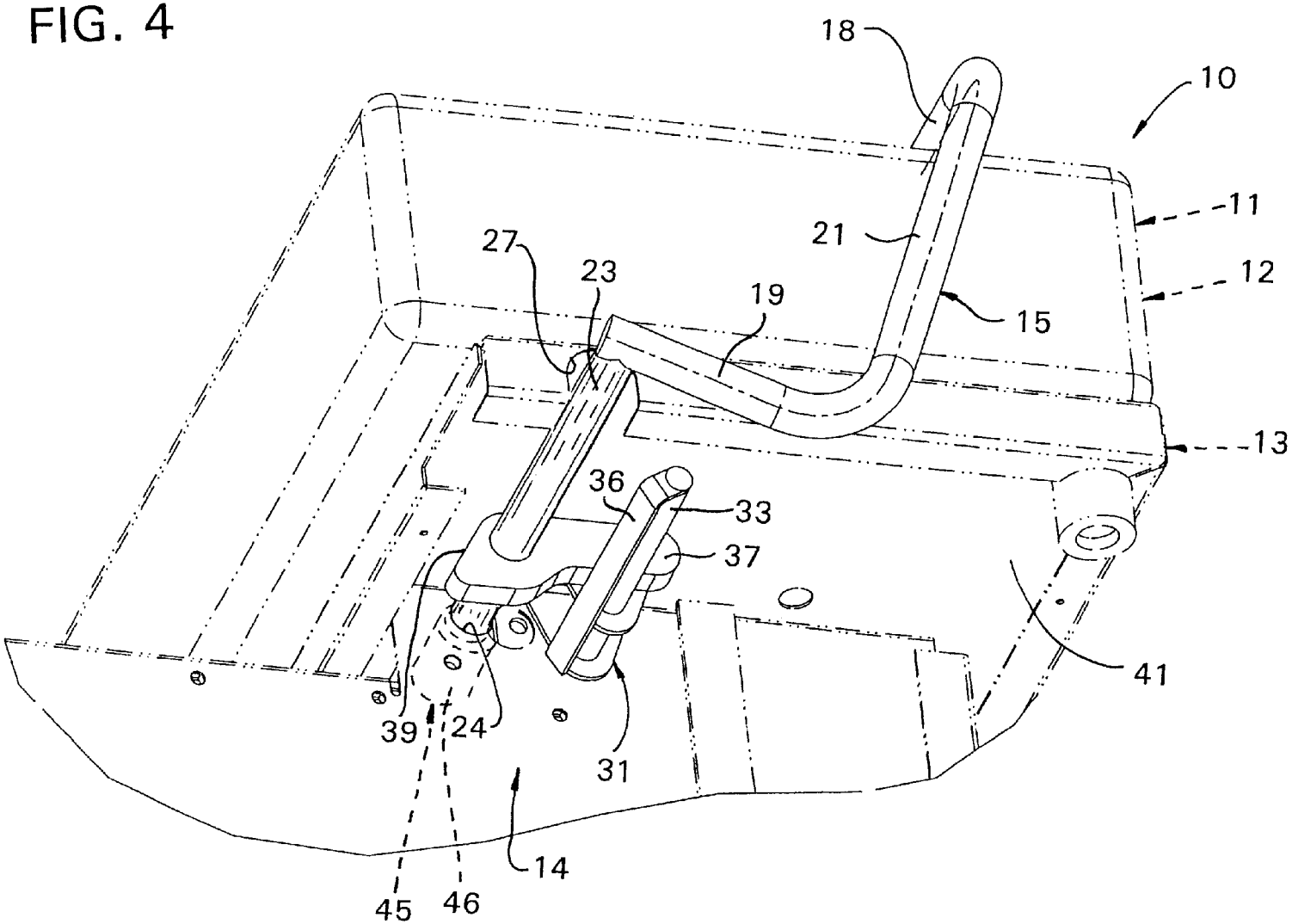
FIG. 4 is a bottom left isometric view of the labor grip mechanism similar to FIG. 1, but in the fully deployed position.
Figure 5:
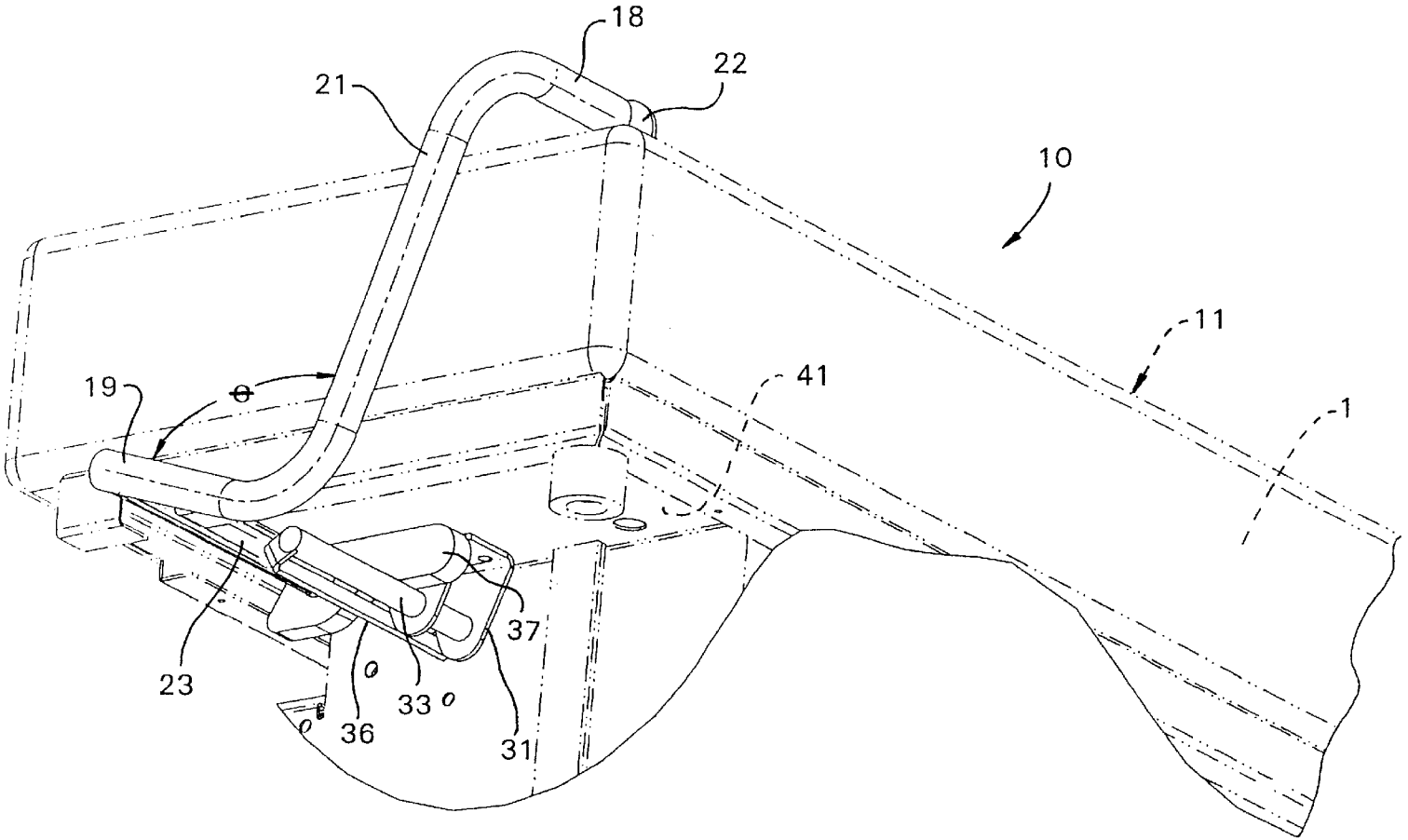
FIG. 5 is a bottom right isometric view of the illustration in FIG. 4.

The labor grip mechanism 15 is movable between the aforesaid first position thereof illustrated in FIG. 1 and the second position thereof illustrated in FIG. 3 by a simple manual force being applied to the post 16 and pulling outwardly in a direction parallel to the longitudinal axis of the straight section 23. In the second position, the cam 37 will be oriented between the distal end of the rod 33 and the edge 34 of the mattress frame 13 so that the cam 37 can be moved therebetween by rotating the labor grip mechanism about the longitudinal axis of the straight section 23. Once the cam 37 is moved to a location generally above the rod 33, the return spring 26 will cause the straight section 23 to retract back into the guide opening 24 to orient the cam 37 on the upper surface of the rod 33 as illustrated in FIG. 4. The base member 31 forms a stop against which the cam 37 will abut when the cam 37 is oriented above the rod 33 as illustrated in FIG. 4. The base 31 effectively orients the cam 37 in a position spaced outwardly from the main frame 14 so that the post sections 19 and 21 of the labor grip mechanism 15 are oriented laterally of the mattress frame 13 and mattress 11 mounted thereon.

As is illustrated in FIG. 3, the cam 37 has a width X. The spacing between the exterior surface of the rod 33 and the undersurface 41 of the mattress frame 13 is equal to the aforesaid distance X or a slightly greater distance so as to facilitate the receipt of the cam 37 snugly therebetween. This snug orientation of the cam 37 between the exterior surface of the rod 33 and the surface 41 of the mattress frame 13 (see FIG. 4) provides a substantial rigidity to the orientation of the hand grip 18 and will provide a perceived sense of security to the birthing mother to cause her to think that as much force as she wishes to place onto the hand grip 18 will be sufficiently supported.

The additional support mechanism or translational device 45 is shown in more detail in FIG. 6. The additional support mechanism or translational device 45 additionally facilitates simultaneous deployment or stowing of both labor grip mechanisms in response to manual forces applied to only one labor grip mechanism 45 to effect deployment or stowing as described above.

More specifically, the additional support mechanism 45 includes a pair of axially spaced hollow bearing members 46 and 47 configured to be fastened to the underside of the mattress frame 13 as schematically represented in FIG. 1. An elongate housing 48 is provided which has a pair of axially aligned openings 49 and 51 in opposite ends which are configured to be coaxially arranged with the holes in the bearing members 46 and 47 so that the straight sections 23 of each labor grip mechanism is axially slidably and rotatively received in and supported by the bearing members 46 and 47 and extend into the interior 52 of the housing. A pair of toothed racks, only one rack 53 is shown in FIG. 6, are slidably supported in corresponding guides 56 and 57. Each rack 53 is secured to an end of the respective straight section 23 that terminates in the interior of the housing. A compression spring 58 encircles each straight section 23 and is oriented between spring abutments formed by each end wall of the housing 48 and the end of the straight section 23 whereat the toothed rack 53 is secured. The racks 53 are spaced from each other and a pinion gear 59 rotatably supported on the housing 48 is configured so that its teeth schematically illustrated at 61 matingly engage the teeth 62 of each rack. As a result, a pulling force applied to one labor grip mechanism 15 to effect a movement thereof from the first position illustrated in FIG. 1 to the second position illustrated in FIG. 3 will cause the driven rack to rotatively drive the pinion gear 59 and cause a corresponding driven movement of the other rack to effect a corresponding and simultaneously occurring deploying movement of the other labor grip mechanism 15. The bearing elements 46 and 47 will enable simultaneous rotation of the straight sections 23 between the second position shown in FIG. 3 to the deployed position where the hand grips 18 are oriented above the upper surface of the mattress 11 as well as vice versa.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a bed having a main frame and a patient support mounted on said main frame, the improvement comprising:

first and second posts, each having a free end;

first mounting means for slidably supporting said posts for simultaneous movement between a first position wherein said free ends are stowed underneath said patient support and a second position wherein said free ends are oriented wholly out from underneath said patient support;

second mounting means for supporting said posts for simultaneous rotational movement between said second position wherein said free ends are also oriented in a plane beneath a plane of said patient support and a third position wherein said free ends are oriented in a plane above the plane of said patient support; and free end positioning means for facilitating said simultaneous rotational movement only when said posts are in said second or third positions.

2. The device according to claim 1, wherein said first and second mounting means are provided on a translational device including a housing with support means being provided for supporting said housing for rotational movement to and between positions corresponding to said second and third positions, said posts being slidably supported on said housing for movement to and between positions corresponding to said first and second positions, said translational device being configured to be responsive to manual forces applied to one of said pair of posts to effect a movement to and between said first and said second and said third positions for implementing a corresponding simultaneous movement of the other of said posts.

3. The device according to claim 2, wherein said translational device includes a pair of spaced parallel toothed racks each slidably mounted on said housing and to said posts and a rotatably supported gear on said housing oriented in the space between said toothed racks and matingly engaging the teeth on each said toothed rack so that a translational movement of one of said toothed racks and a respective one of said posts secured thereto will cause a corresponding and simultaneous translational movement of the other of said toothed racks and a respective other of said posts secured thereto.

4. The device according to claim 3, wherein said translational device includes a pair of elongate guides having a longitudinal axis that extends generally perpendicular to a longitudinal axis of said patient support;

wherein each of said posts include a straight section at an end thereof remote from said hand grip, said straight section being rotatably and axially slidingly received in a respective said elongate guide and supported for said movement thereof between said first and second positions and said second and third positions;

wherein said free end positioning means includes at least one elongate member separate from said straight sections and extending generally parallel to said at least one straight section, a first end of said at least one elongate member being secured to said main frame, a second end of said elongate member being oriented beneath said patient support; and wherein said at least one straight section has secured thereto an elongate arm extending in a plane oriented perpendicular to said longitudinal axis of said elongate guides, said elongate arm slidingly abutting a first side of said at least one elongate member when said straight section is transitioning between said first and second positions to thereby prevent rotation of said posts from said second position toward said third position thereof while simultaneously permitting a simultaneous axial transition of said straight sections and said elongate arm on at least one thereof toward said second position thereof, said elongate arm being free of abutting relation with said at least one elongate member when said post is in said second position thereof to thereby permit simultaneous rotation of said post from said second position to said third position.

5. The device according to claim 4, wherein said at least one straight section of said posts and said elongate arm thereon is supported for movement to a position where said elongate arm is in abutting relation with a second side of said elongate member as said posts transition from said third position to a fourth position to simultaneously orient a section of each of said posts intermediate said straight section and said hand grip laterally of said patient support to orient said hand grips in said plane above said patient support.

6. The device according to claim 5, wherein said free end positioning means further includes a stop located intermediate said first and second ends of said elongate member and oriented in a path of movement of said elongate arm during a transitioning of said at least one straight section of said post from said third position toward said fourth position whereat said elongate arm abuts said stop so that said hand grips are simultaneously oriented in said plane above said patient support.

7. The device according to claim 5, wherein said translational device includes a spring device for simultaneously continuously urging said posts toward said first or fourth positions thereof.

8. The device according to claim 2, wherein said translational device includes a spring device for simultaneously continuously urging said posts toward said first position thereof.

* * * * *